US006527500B1

(12) United States Patent
Gelardi et al.

(10) Patent No.: US 6,527,500 B1
(45) Date of Patent: Mar. 4, 2003

(54) AUTOMATED PACKAGING SYSTEM FOR LOADING COMPACT DISCS AND BOOKLETS INTO COMPACT DISC CASES

(75) Inventors: John A. Gelardi, Kennebunkport, ME (US); Albert Belanger, Scarburough, ME (US); Guy Lessard, Biddeford, ME (US)

(73) Assignee: Sagoma Plastics, Biddeford, ME (US)

( * ) Notice: Subject to any disclaimer, the term of this patent is extended or adjusted under 35 U.S.C. 154(b) by 0 days.

(21) Appl. No.: 09/468,780

(22) Filed: Dec. 21, 1999

Related U.S. Application Data

(60) Provisional application No. 60/117,603, filed on Jan. 27, 1999.

(51) Int. Cl.[7] ..... B65B 25/00

(52) U.S. Cl. ..... 414/788.1; 414/795.4; 414/801; 414/802; 53/50; 53/238; 53/254; 53/468

(58) Field of Search ..... 414/801, 802, 414/788, 788.1, 795.4, 796.5, 796.9, 797; 53/50, 238, 240, 249, 254, 377.6, 382.1, 382.2, 468, 474

(56) References Cited

U.S. PATENT DOCUMENTS

| | | | | |
|---|---|---|---|---|
| 3,896,606 A | * | 7/1975 | Utsumi | 53/238 X |
| 4,201,027 A | | 5/1980 | Ilsemann | |
| 4,297,826 A | | 11/1981 | Woertche | |
| 4,523,422 A | | 6/1985 | Ilsemann | |

(List continued on next page.)

FOREIGN PATENT DOCUMENTS

| | | | |
|---|---|---|---|
| EP | 776830 | * | 6/1997 |
| JP | 06-293321 | * | 10/1994 |
| WO | WO 93/10002 | * | 5/1993 |

OTHER PUBLICATIONS

Advertisement by Automated Systems, Inc. for CD packaging machines (undated).

*Primary Examiner*—Robert P. Olszewski
*Assistant Examiner*—Gerald J. O'Connor
(74) *Attorney, Agent, or Firm*—James Creighton Wray; Meera P. Narasimhan

(57) ABSTRACT

An insertion automation apparatus for discs and booklets in disc packages has plural parallel belts for transporting containers through successive stations. A first station is adjacent the belts for unstacking containers. A second station is adjacent the belts for opening the containers. An inspection station adjacent the belts inspects the opened containers. A fourth station adjacent the belts partially inserts booklets in the open containers, has a booklet conveyor for unstacking and moving booklets and an insertion conveyor for partially inserting the booklets in booklet pockets of the containers. A fifth station adjacent the belts has a pusher for pushing booklets fully into the pockets. A sixth disc placement station adjacent the belts has a continuous looped disc carrier arranged transversely to the belts and plural outwardly spaced disc carrier heads facing outward from the looped disc carrier. Suction lifters are positioned adjacent one end of the looped disc carrier for engaging and lifting discs from a top of an active stack and pulling the discs onto the carrier heads. Second placement heads move vertically with respect to the carrier, engage the discs on the carrier heads and push the discs from the carrier heads to a disc holder in the package on the belts at the sixth station. A disc stack transfer is mounted at one side of the belt and extends longitudinally in the direction of the belts. A seventh position inspects the containers with the discs and booklets inserted therein. An eighth station has a closer for closing the disc containers, and a ninth station unloads the closed disc containers.

8 Claims, 13 Drawing Sheets

U.S. PATENT DOCUMENTS 4,551,966 A * 11/1985 Aoyagi et al. ..... 53/254 X
4,594,837 A 6/1986 Zielke
4,685,277 A 8/1987 Ilsemann
4,709,812 A 12/1987 Kosterka
4,733,519 A 3/1988 Harper et al.
4,852,327 A 8/1989 Kurkowski et al.
4,881,356 A * 11/1989 Beezer et al. ..... 53/382.1 X
5,163,271 A 11/1992 Pan et al.
5,207,050 A 5/1993 Fulkerson et al.
5,285,620 A 2/1994 Kaye et al.
5,341,624 A 8/1994 Kaye
5,561,962 A 10/1996 Everhard et al.
5,664,405 A * 9/1997 Perego ..... 53/468 X
5,718,559 A * 2/1998 Freund ..... 53/797
5,788,114 A * 8/1998 Perego ..... 53/468 X
5,816,028 A 10/1998 Zaniboni
5,844,593 A * 12/1998 Proffitt et al. ..... 347/262
5,943,845 A * 8/1999 Ilsemann ..... 53/468
6,032,435 A * 3/2000 Zaniboni ..... 53/238 X

* cited by examiner 101
89
87
91
37
ZONE 1
ZONE 2
ZONE 3
ZONE 4

AUTOMATED PACKAGING SYSTEM FOR LOADING COMPACT DISCS AND BOOKLETS INTO COMPACT DISC CASES

This application claims the benefit of U.S. Provisional Application No. 60/117,603, filed Jan. 27, 1999.

BACKGROUND OF THE INVENTION

Summary of the Invention

The new automation inserts booklets, folded papers, or insert materials in pockets within disc packages and inserts discs in disc-receiving recesses and on disc-receiving rosettes within the disc receiving packages. All of the parts which are assembled continually move forward. All of the principal part moving assemblies continually move forward, so that there is no delay required for return time of the parts handling equipment.

Booklets are moved in single arrangement on conveyors stepped by several motors. When the conveyors stop, a pick and place assembly moves the booklet onto a stopped joined high-speed insertion assembly between drive tabs on parallel drive belts. The high-speed drive belts put the booklet partially into a pocket when the disc package is stopped. An air-operated pusher laterally connected to the discharge end of the high-speed inserter cycles to complete the pushing of the booklet into the pocket at the next station.

Discs to be inserted into the packages are stacked on spindles. A disc insertion or disc transfer conveyor has several outwardly directed spindles with spring detents. Vacuum heads on a disc pick head lift the top disc from the active stacking spindle and pull the disc up onto the aligned transfer spindle. Spring-mounted ball detents hold the disc; vacuum is released, and the pick up is moved out of contact with the disc. An air cylinder cycles the disc pick up head downward and upward. The disc insertion transfer conveyor is stepped with the transverse stepping of the package conveyor belts. A disc place head is aligned with a spindle on the disc inserting transfer conveyor and the recess in the package tray. The disc place head is moved downward to engage in the disc with vacuum heads and strip the disc from the carrying spindle and move it into the recess and onto the rosette within the recess.

More than one booklet and more than one disc may be inserted within a single package. The insertion automation of the present invention serves packaging of any size disc. Although booklets are generally used in the description, the booklets folded papers or insert materials which need to be inserted in the disc package.

Movements of the servo motors to drive the main package conveyors in steps between stations and to step the booklet conveyor and the high-speed booklet insertion assembly and to step the disc insertion transfer assembly are coordinated with air cylinders to move the booklet pick and place transfer, the booklet pusher, the disc pick head and disc place head. The disc transfer and insertion assembly may be positioned at any place along the machine head which is served by the disc spindle unstacker. The disc place head may be located at any position along the disc transfer and insertion assembly to insert the disc into recesses of the packages located at any zone. The booklet inserter may be slid back and forth on wheels and secured in position to insert the booklet in a pocket in any zone. The whole booklet insertion system which includes the shingled booklet stepper conveyor, the pick and place head, the high-speed inserter conveyor with hold-down rails, and the laterally mounted pusher head may be moved along the rails and fixed in position to align with pickets in the packages. The rail supports may be moved along the machine to any desired position.

The main elements of the system are always moving forward and never backing up. The system breaks up the steps into smaller steps so that the system does not have to back up. For example, the booklet is partially inserted in one station and fully inserted in the next station. The discs are moved part of the way to the insertion location with each forward step. The booklets are moved part of the way to the insertion station with each forward step. Both insertion systems for the booklets and the discs anticipate packaging changes so that different packages may be readily accommodated.

The new machine is capable of inserting compact discs and booklets into disc packages with 4,6, and 8 panel board configurations at 60 plus parts per minute. The disc placement can be done on any of the four possible tray locations on an eight panel or less package. Booklets can be inserted into a variety of pocket configurations. The booklet insertion station transfer and insertion head are mounted on rails, allowing for booklets to be inserted into any of three panel locations.

The booklet and disc insertion machine can be delivered to handle standard sized discs, inserts, and packages. If production needs change, the machines can be converted into systems to assemble the new desired formats.

The module can also run dual 2 panel packages or dual 4 panel packages during one machine cycle. That allows for more parts per minute to be produced with the same machine. The module runs at 60 cycles per minute in the 4 panel dual mode but output increases by an additional 60 parts per minute for a total output per minute of 120 parts.

This new machine is capable of inserting compact discs and booklets into 4,6, and 8 panel board CD packages. The disc placement can be done on any of the four possible tray locations (Zones) on an eight panel or less package without decreasing the speed of the machine. The booklet can be inserted into fish mouth, full sleeve, and angled panel pockets.

The new machine can also run in dual 4 panel packages during one machine cycle. That allows for more parts per minute to be produced with the same machine. The module runs at 60 cycles per minute in the 4 panel dual mode, but output increases by an additional 60 parts per minute for a total output per minute of 120 parts. Machine changeover times for 4, dual 4, to 6 to 8 panel configurations, being done by a trained individual, take less than one hour. Results and final alignment may vary depending on the quality of the materials supplied to the machine.

To assist in machine changeovers, preset programs are stored in the on-board computer, and accessed through the key pad on the system. The program changes are done by pushing one of the 12 "F" keys and then the return button located on the control panel. The selected program will turn on or off appropriate stations, sensors, and change display information. The machine also comes with station position sensors that are used to assist in the changeover as well as prevent mishap. The sensors confirm that station adjustments have been completed. If the changes are not completed by the machine, the machine will not index. The system will then display the station(s) that have to be moved and or the adjustment needed. The system also presents information such as current machine speed, number of good or bad parts produced, and the general status of the machine.

The new machine functions as follows:

1. Feeds flat 4,6,8 panel board with tray pre-attached.
2. Places one booklet into a pocket, one zone per pass (adjustable to place glue on Zone 1,2,3).
3. Places one compact disc onto tray one zone per pass (adjustable to place discs on to Zone 1,2,3,4), or places one compact disc onto tray one zone per pass per 4 panel, dual 4 panel mode (place discs on to Zone 2 and 3).
4. Inspects for rejects.
5. Removes rejects.
6. Out feeds finished product in the open position
7. Does the above at a rate of 60 parts per minute (exception of dual 4 panel use) machine.

The new machine operates at a speed of 60 plus parts per minute, or 120 plus parts per minute in Dual 4 Panel Mode. The modules include:

Magazine-fed down stacker

Servo-driven main transfer system

Photo-electric sensing system

Servo-driven 3 zone booklet insertion station

Buffered two spindle up-stacker for discs (400 pieces)

Dual 4 panel guides and program

Servo-driven disc transfer system with 4 zone place positions

Inspection station (ultrasonic)

Reject station (up-stacker)

Out-feed shingling conveyor

Close Station (4,6,8 panel)

The new machine features an on-board automation computer with:

Link up capabilities

Systems display and keypad

Pneumatic air cylinders and valves with high speed options

Modular design for free standing or in-line operation

Module mounted on heavy duty casters

All shrouding and doors with safety interlocks

Servos on all main drive systems

Requirements:

Electrical: 120v, 20 A, AC or to customer specifications.

Pneumatic: 80 psi clean dry air

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
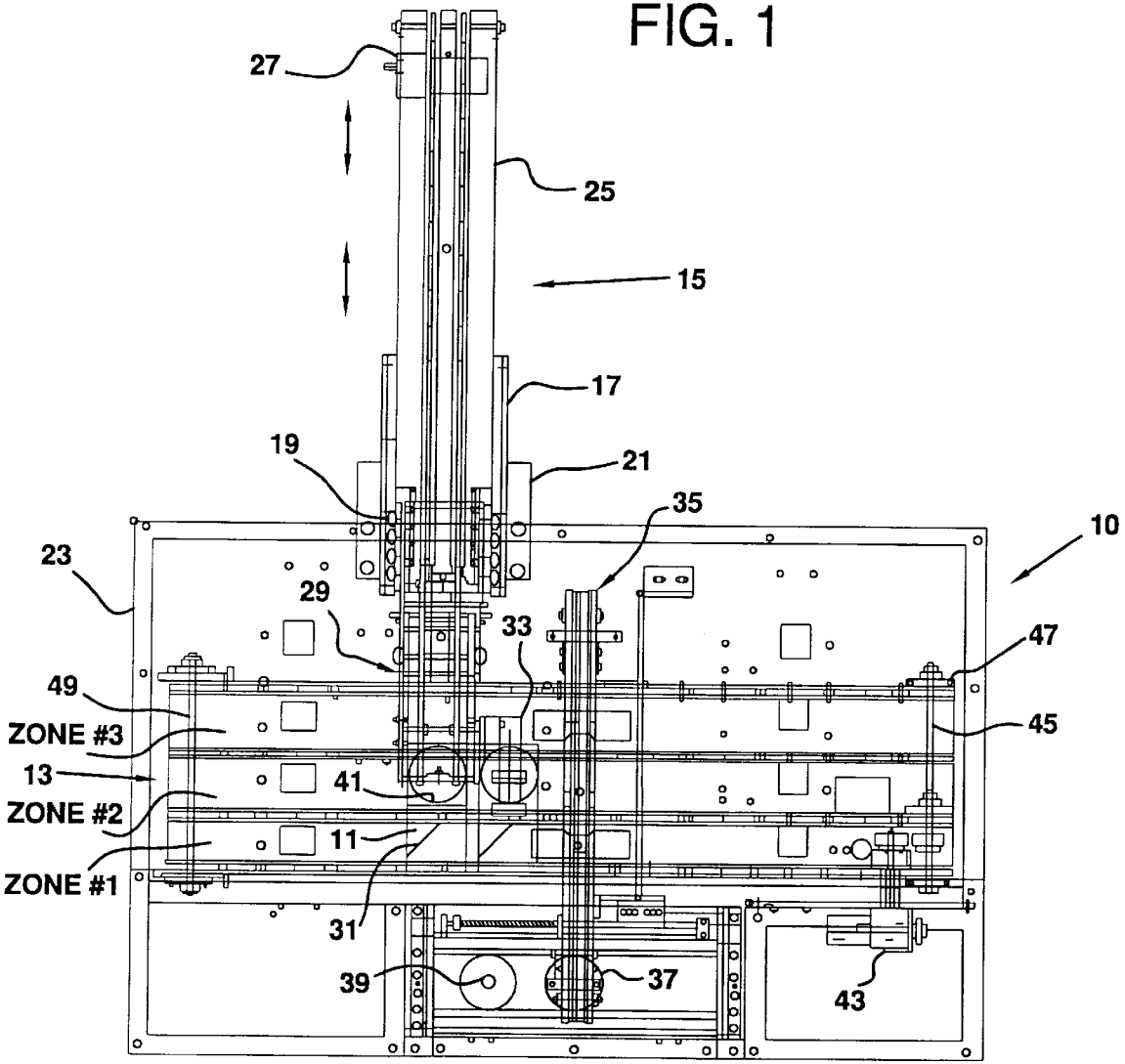
FIG. 1 is a plan view of the machine for inserting booklets and discs in CD packages.

Referring to FIG. 1, an insertion automation machine is generally indicated by the numeral 10. CD packages 11 are unstacked and opened on parallel belt drives 13 so that the opened CD packages occupy zones 1, 2 and 3 or 1, 2, 3, and a fourth zone for which a parallel belt drive may be added. The booklet, folded paper or sheet material inserter 15 moves in and out on rails 17, allowing inserts to be placed in zones 1, 2, and 3, and even zone 4 if that is appropriate. In the example, the inserts are inserted in zone 1. The rails are generally indicated by the numeral 17. Rollers 19 are connected to the inserter frame 15, which supports the shingled booklet conveyor, the pick and place transfer, the high speed inserter and the pusher that insert the booklets, folded papers, or sheet materials.

The rails 17 are mounted on brackets 21, which are bolted to the machine frame 23. The booklets, folded paper or sheet material are shingled on the parallel flat belt conveyors 25, which are stepped in small increments by servo motor 27. The insertion head assembly 29 has belts with drive tabs which move the booklets downward under adjustable hold-down rails to push the booklets, folded paper or sheet material partially into the pockets 31 in the containers 11. A pusher head 33 mounted beside the high-speed injection head assembly 29 completes the pushing of the booklets, folded paper or sheet material into the pockets 31. A disc insertion assembly 35 picks up discs 37 from the top of the stack on the active one of parallel disc stack holding spindles 39, which is aligned under the disc insertion assembly. The disc insertion assembly then transfers the disc to the position immediately above the disc receiving recess 41 in the package 11, where a disc place head pushes the disc from the disc insertion assembly into the recess 41. A stepper servo motor 43 steps the parallel zone 1, 2 and 3 conveyors 13, which are driven by drive axle 45 mounted on bearings 47. A fourth zone conveyor 13 may be added in the space provided and driven by the same stepper motor 43 by extending the drive axle 45 and the idler axle 49.

Figure 2:
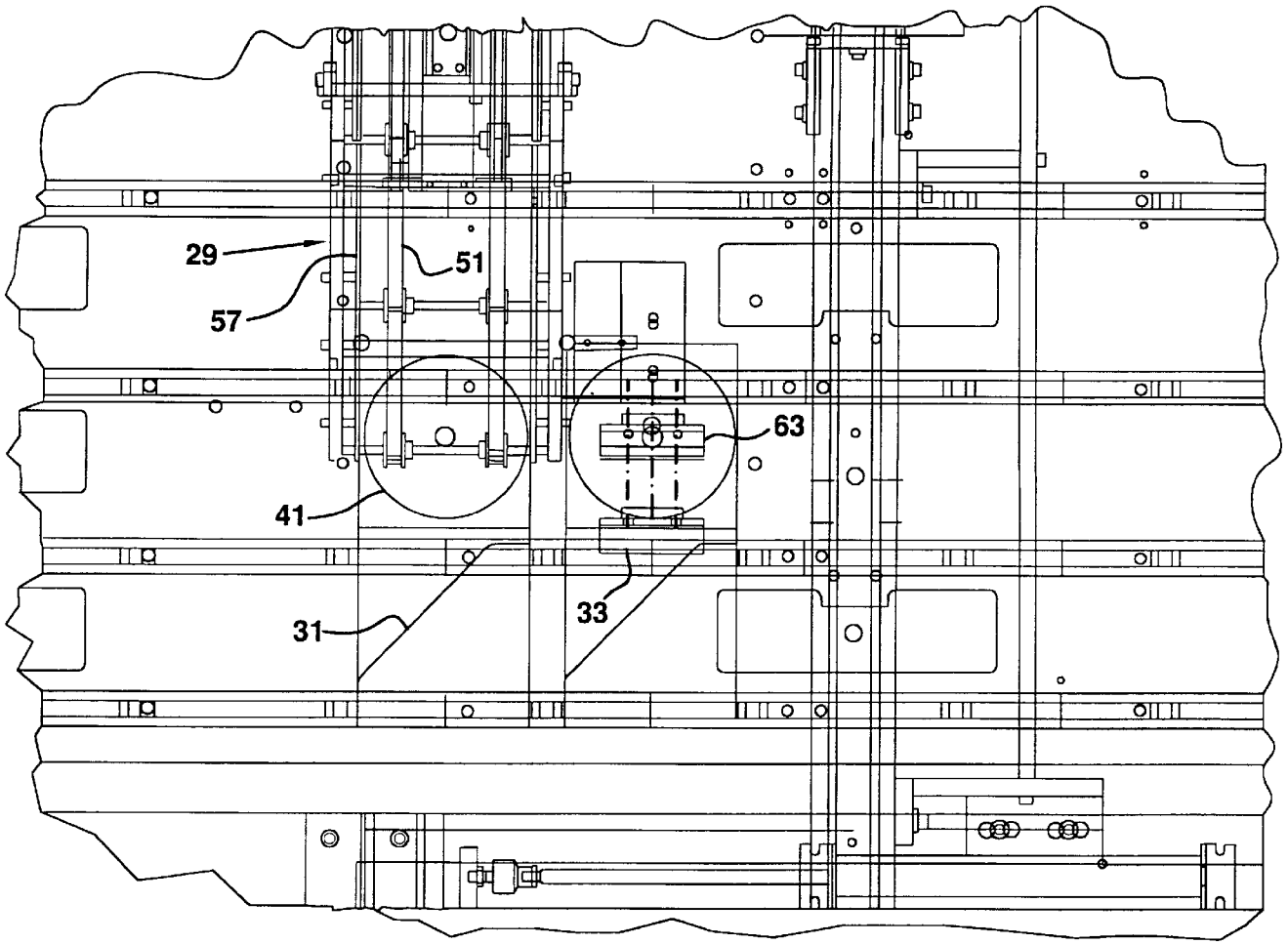
FIG. 2 is a detail of the booklet insertion head and pusher head in plan view.
Figure 3:
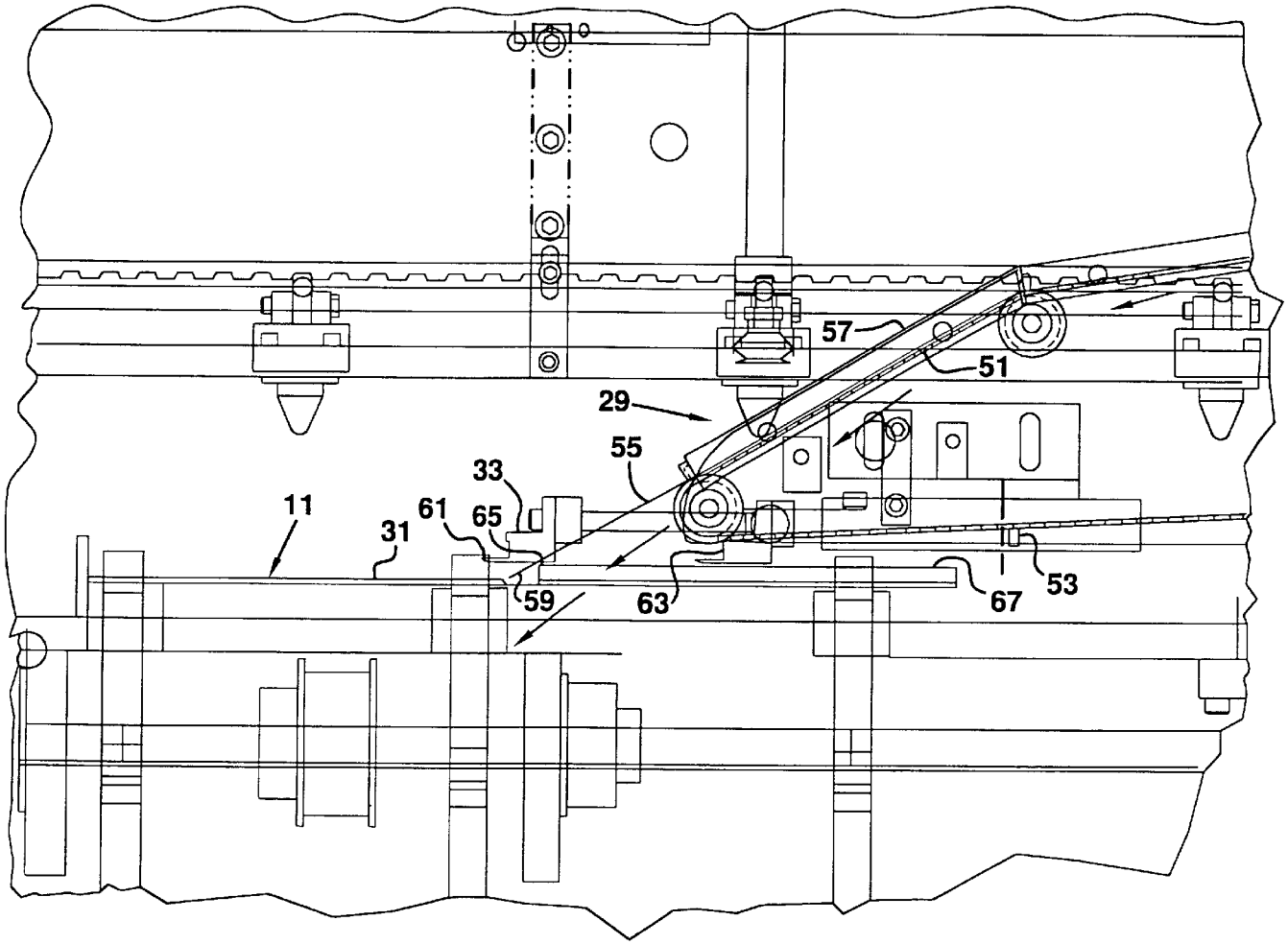
FIG. 3 is an elevation detail of the booklet inserter and pusher head.

FIG. 2 is a top detail of the high-speed insertion head 29. FIG. 3 shows a side elevation of that high-speed insertion head assembly 29. High-speed parallel conveyor belts 51 with drive tabs 53 push the booklets, folded paper or sheet material under hold-down rails 57 and partially into the pockets 31 of the package 11. The front-end 59 of the booklet is pushed into the pocket 31. The rear end of the booklet drops onto ledge 61 of the pusher head 33. The pusher head reciprocates forward to the position shown in FIG. 3 and then withdraws to its back position 63, leaving the booklet fully inserted in the pocket 31. The partially inserted booklet 55 moves with the CD package 11 as the package is stepped into the next position on the conveyors 13. That stepping aligns the booklet with the pusher head. The trailing end of the booklet is held upward by the edge 65 of the tray 67 of the package 11. The pusher head 33 pushes the booklet completely forward into the pocket 31 and then withdraws to drop the trailing end of the booklet into flat alignment with the pocket. The booklet is fed partially into the pocket during the stop of the package 11 in alignment with the high-speed booklet insertion head 29. Upon the next stop of the container 11, the booklet is fully inserted into the pocket by reciprocation and withdrawal of the pusher head 33.

Figure 4:
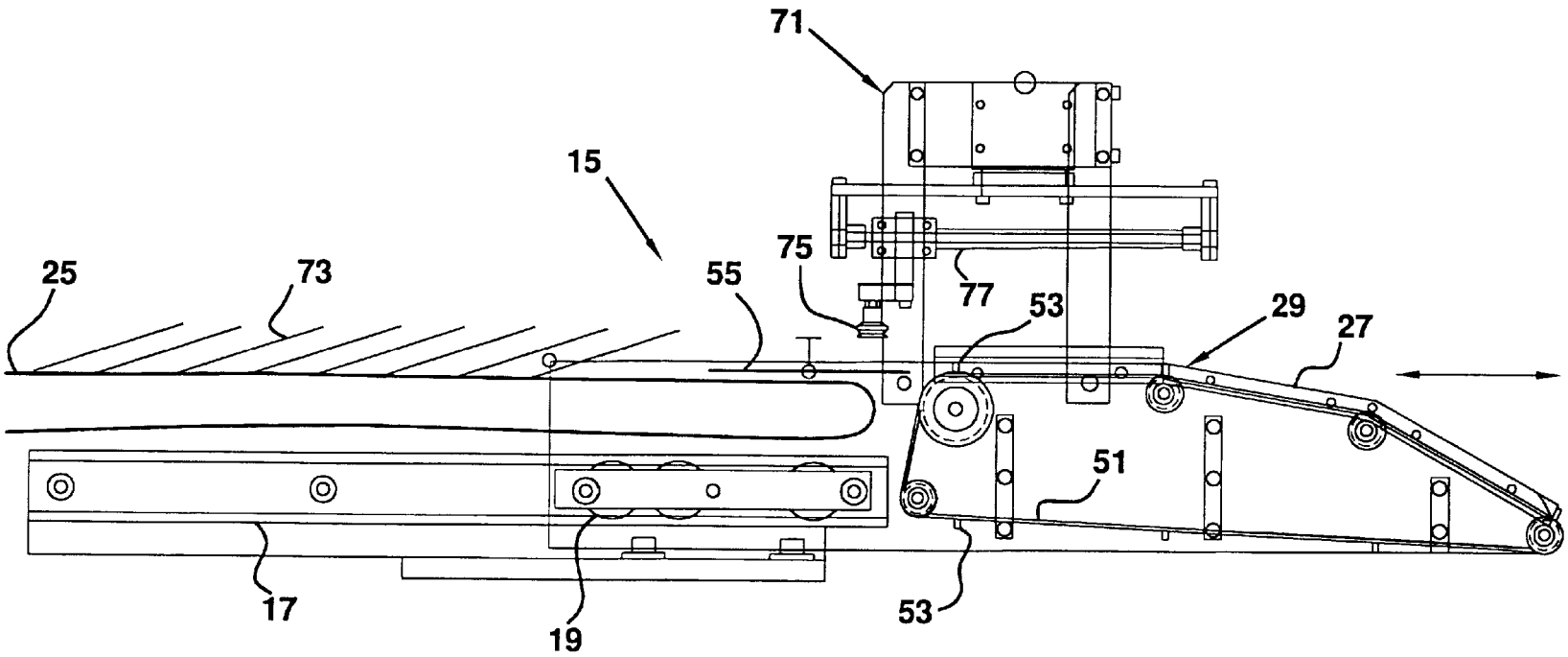
FIG. 4 is an input side view of the book station.
Figure 5:
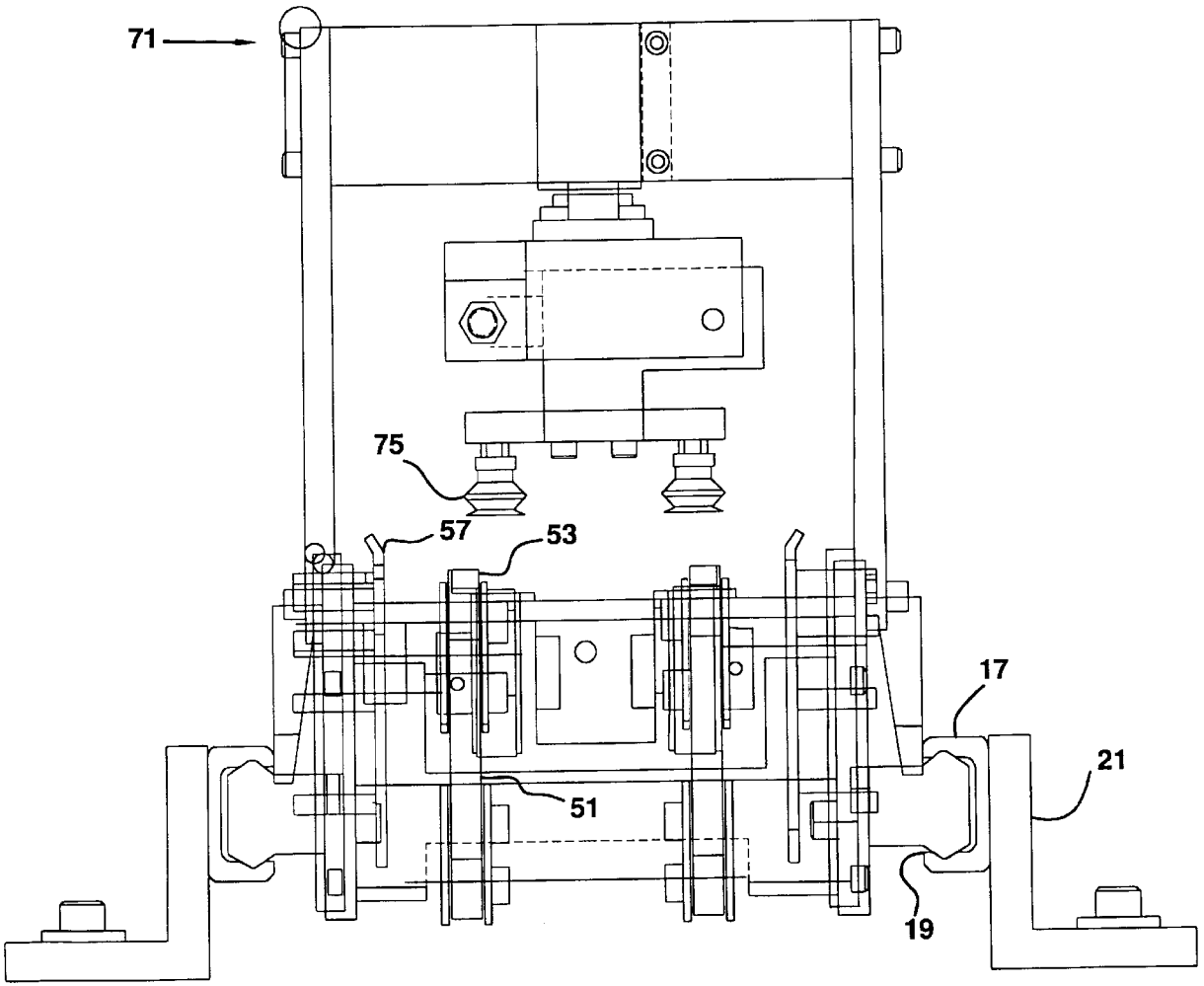
FIG. 5 is a front view of the book pick and place and insert station.

As shown in FIGS. 4 and 5 a pick and place mechanism 71 moves inserts 55 from a shingled arrangement 73 on conveyor 25 onto the high-speed insertion assembly 29. The pick and place assembly has vacuum heads 75 which pick up the front end of the first book 55 from the shingled stack 73 and which picks the insert booklet from the flat belt conveyors 25 and places them on the high-speed drive belt 51 between drop tabs 53. The entire booklet insertion assembly 15 is mounted on the rails 17. The bearing rollers 19 allow the shingled inserts conveyor 25, the high-speed insertion head 29, the pusher head 33 and the pick and place transfer 71 to be relocated so that the end of the insertion head is aligned to drive the insert into a pocket in the package. The insert stack conveyor 25 is stepped ahead at lower linear speeds than the high-speed insertion head belts.

Hold down rails 57 hold down the booklets as they are carried along the high-speed drive belts 51 and pushed by the drive tabs 53 into the package pockets 31. As shown in FIG. 4, at any time, three booklets are positioned on the high-speed drive head, the lead booklet is partially pushed into the container pocket by tabs 53 when the container is stopped at a first station. The lifting heads 75 are reciprocated forward along rails 77 before the high-speed belts 51 are stepped forward. One or more drive belts 51 may be used. One or more conveyor belts 25 may be used. The stepper motor 27 steps the belts 25 in short increments and steps the belts 51 in high speed insertion head assembly 29 in larger increments, for example, 6 inches.

An air cylinder moves the vacuum pick heads 75 down and up, and another air cylinder moves the pick head assembly forward and backward. The air cylinders are coordinated so that when the drive conveyors 25 stop, the pick heads 75 are driven downward, then over onto the stopped belts 51. A similar cylinder 79 drives the pusher head 33 forward and then rearward when the drive belts 13 are stopped.

Figure 6:
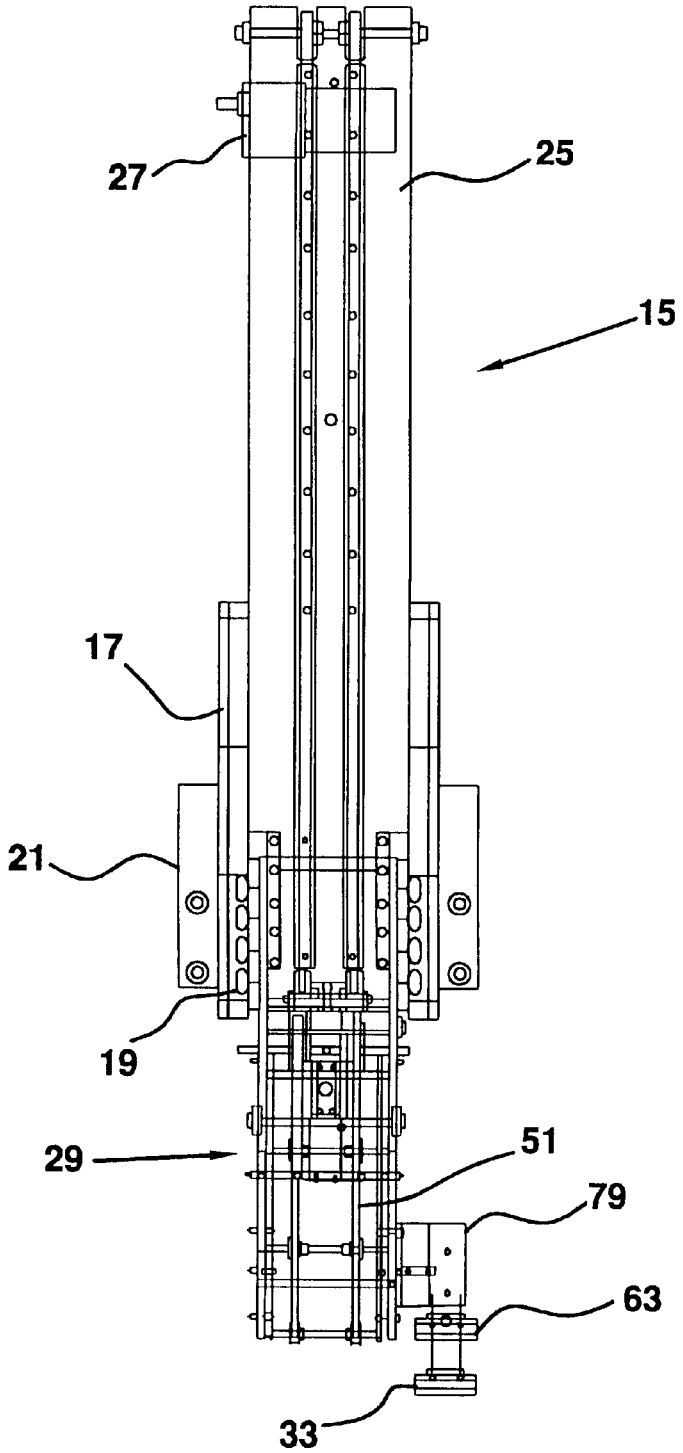
FIG. 6 is a top view of the book insert station.
Figure 7:
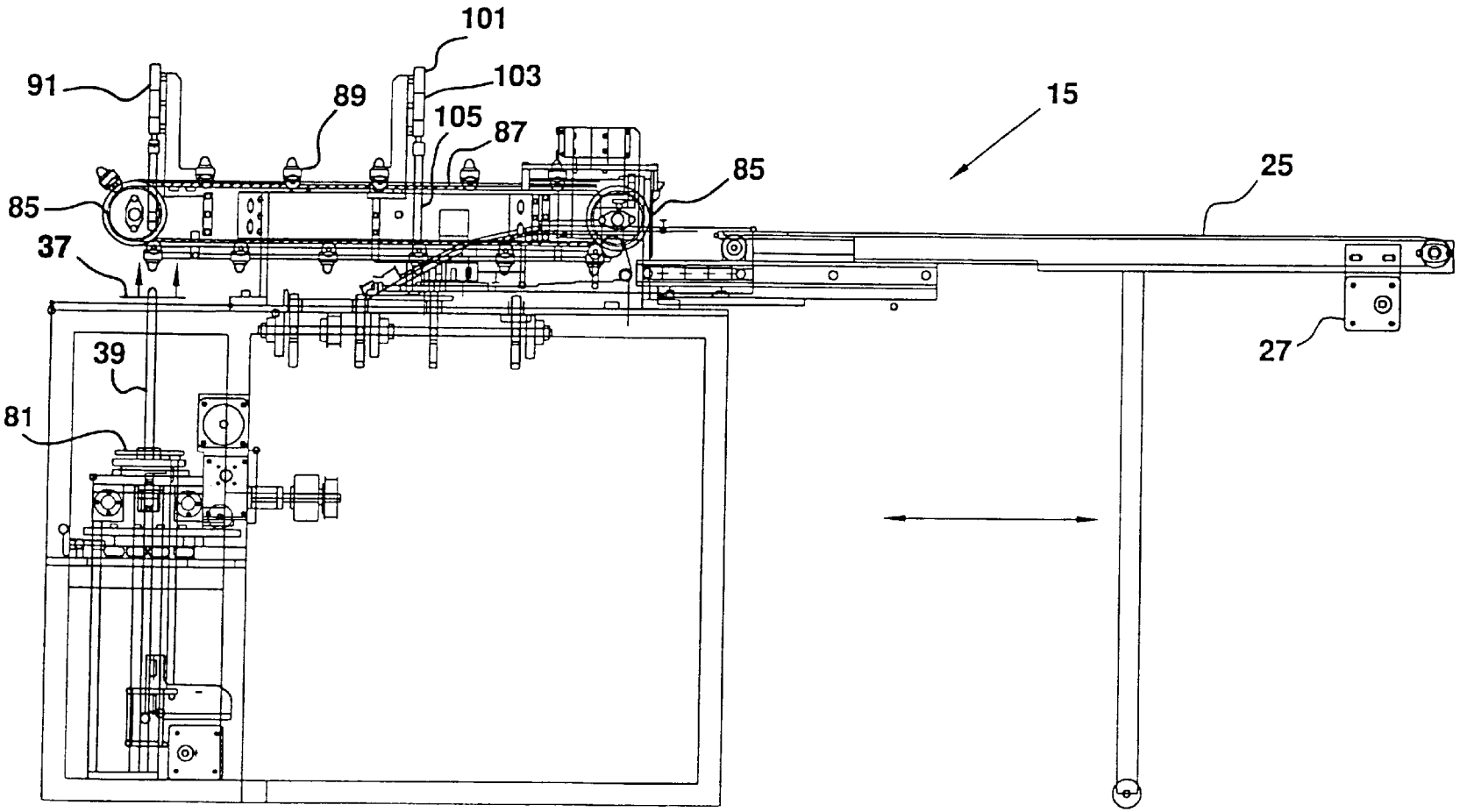
FIG. 7 is a side view of the machine, showing the disc transfer and insertion assembly and pickup and placement heads.
Figures 8A, 8B, 8C:
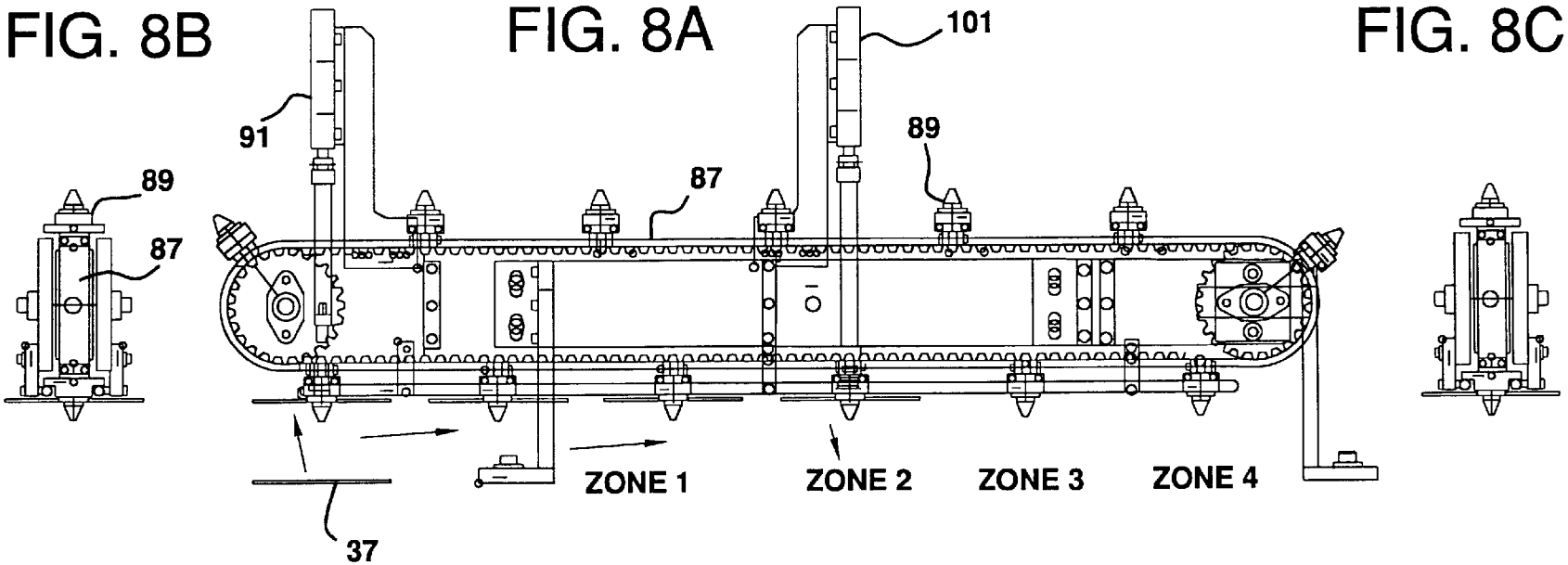
FIGS. 8A, 8B, and 8C are front, side, and opposite side views of a disc placement head with discs mounted on spindles.

FIG. 6 is a top view of the booklet insert station 15.

Figure 9:
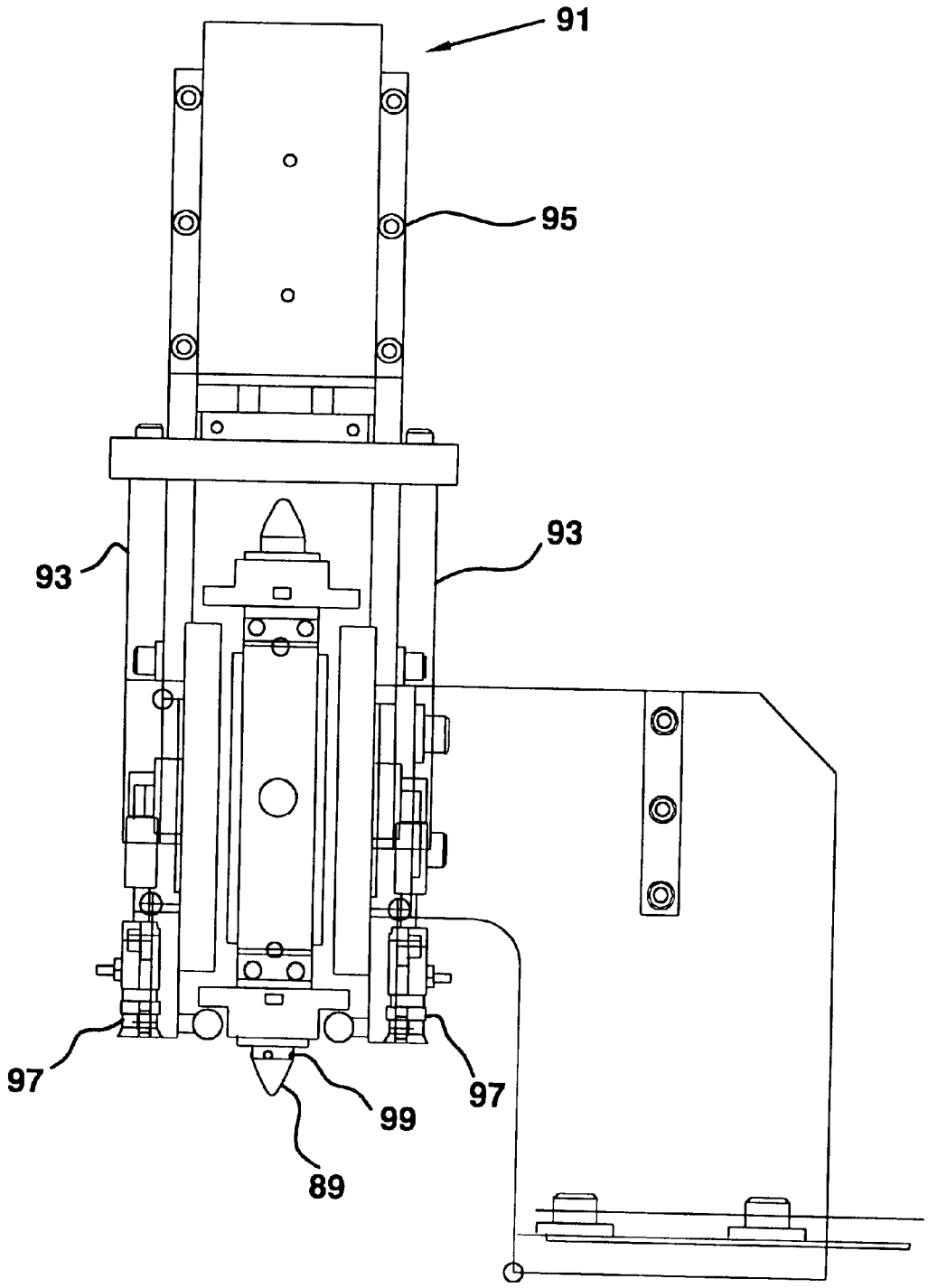
FIG. 9 is an end-view of the disc pick head and mounting bracket.

FIGS. 7, 8A, 8B, 8C and 9 show the disc insertion assembly 35. Discs 37 are stacked on a storage spindle 39 and are moved upward on the spindle by a plate 81 so that the uppermost disc 37 is near the top of the spindle 39. When one spindle 39 is emptied, the second idle spindle is moved into operative position. A disc transfer servo motor drives gears 85 to step the belt 87 on which disc-carrying spindle heads 89 are mounted. A disc pickup head 91 has a parallel legs 93 which are driven upward and downward by an air motor. Guide rollers 95 keep the disc pickup assembly vertically aligned. Vacuum pick up heads 97 at the bottom of the parallel legs move downward to contact the uppermost disc 37 on the stack and move upward to draw the disc 37 onto a carrier spindle 89. Three spring-loaded ball detents 99, as shown in FIG. 9, hold the disc on the spindle 89.

The loaded carrier spindles 89 are stepped to the right as shown in FIGS. 7 and 8A, 8B, and 8C. In the case shown in FIG. 2, the carrier spindles 89 are to be unloaded in Zone 2. A relocatable disc place station similar to the disc pick head is mounted on the frame of the disc insertion assembly 35. The disc place head 101 has an air cylinder 103 which drives parallel arms 105 downward as guided and aligned by rollers 95. Vacuum cups 97 at the lower ends of the arms 105 connect to the disc 37 and push the disc over the detents 99, off of the spindle 89 and into the recess 41 in the package and onto the disc-holding rosette within the recess 41.

Figure 10:
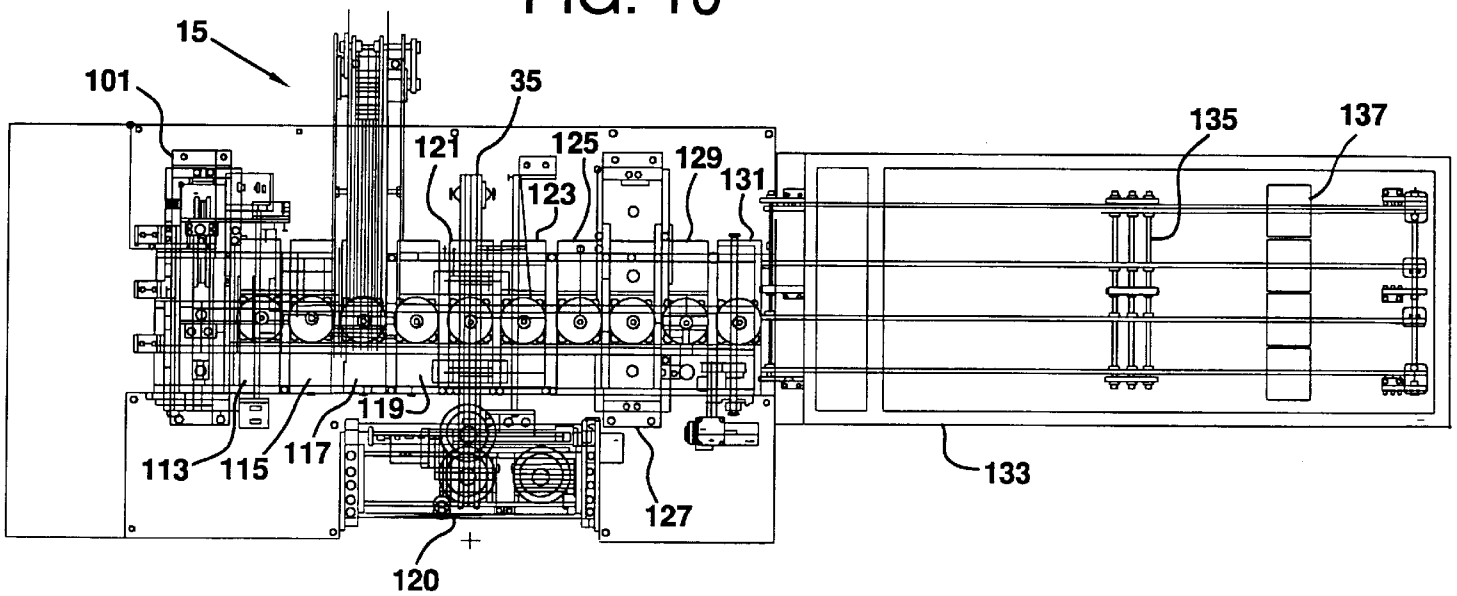
FIG. 10 is a tray placement zone schematic representation.
Figure 12:
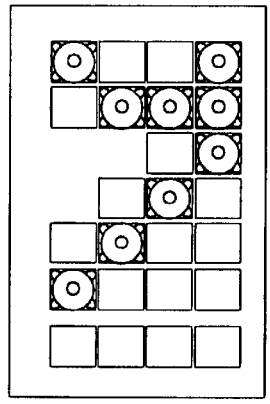
FIG. 12 is a perspective detail of the booklet insertion.
Figure 11:
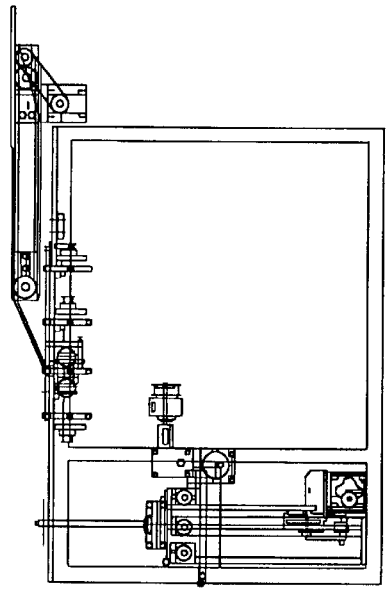
FIG. 11 is a perspective view of the insertion machine.

FIGS. 10, 11, and 12 show the overall machine and the relative locations of the elements. In FIG. 10, a package unstacker is generally indicated by the numeral 111. The containers are unstacked and laid open. A glue station 113 may apply glue if booklets, folded papers, or inserts are to be glued in place. The containers are laid flat and inspected in station 115. Booklet insertion assembly 15 occupies stations 117 and 119. Station 120 is a dual-disc stacking spindle buffer station which aligns an active spindle 39 with station 121 and the disc insertion assembly 35. Station 123 is a tray seating station, and station 125 is a tray inspection station. Station 127 is a board rejection station. Stations 129 and 131 may be package inspection stations. The finished product conveyor is generally indicated by the number 133 and may include a closing station 135 and a stacking station 137. FIG. 11 provides a side view of the machine and the booklet insertion station 15 and the disc spindle unstacker 139.

FIG. 12 shows potential tray placement zones for receiving up to four discs and up to four conveyor zones.

Figure 13:
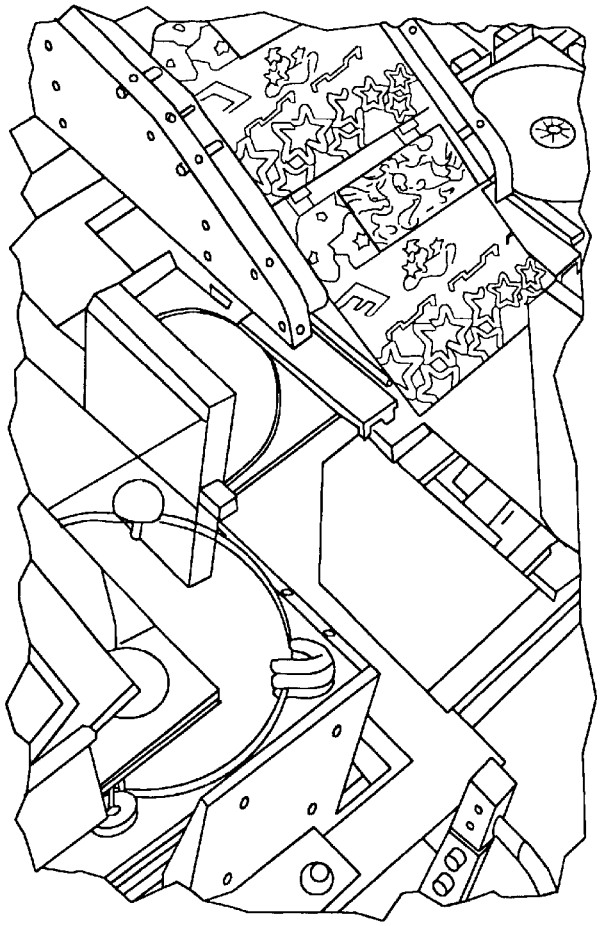
FIG. 13 is a perspective view of a downstacker and booklet station.

FIG. 13 is a perspective view of the package unstacker and booklet insertion station.

Figure 14:
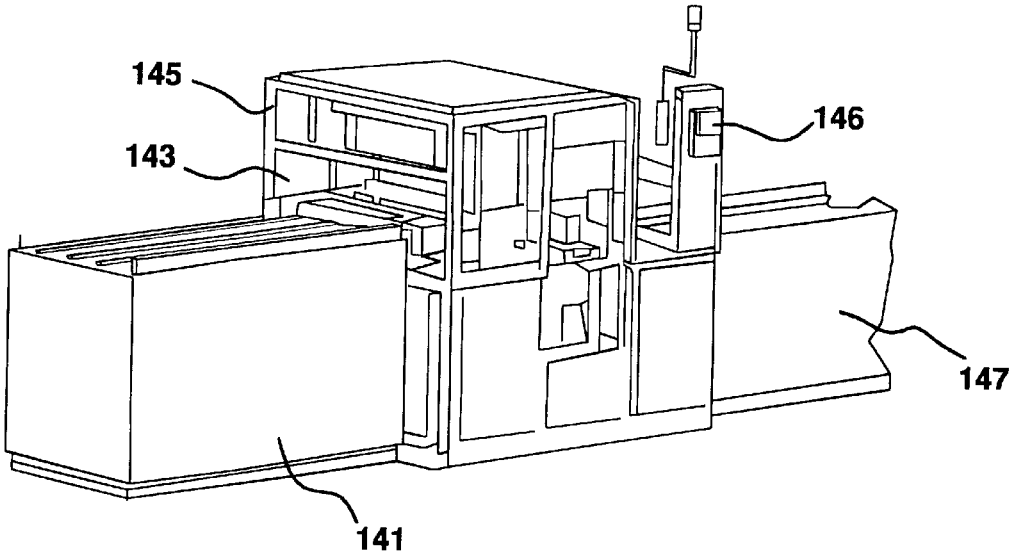
FIG. 14 is a perspective detail of the downstacker and booklet stations.

FIG. 14 is an overall view of the machine with an end feed system 141 for the packages and a main module 143 which includes a noise reducing enclosure 145, the computer control and display system 145, and the closing module 147.

Figure 15:
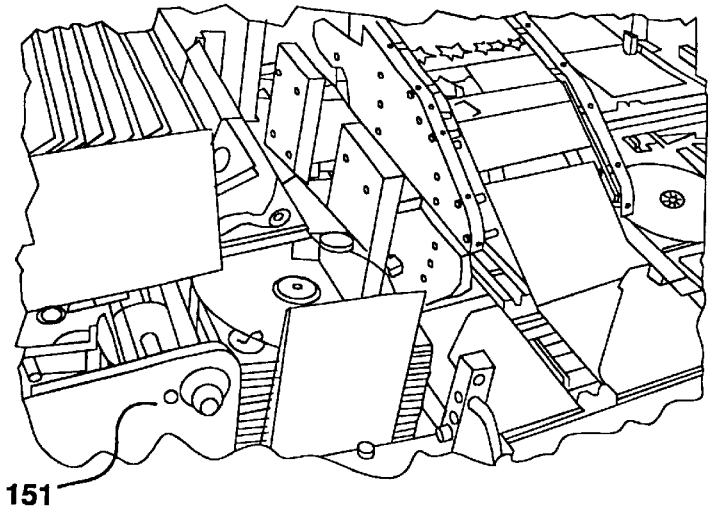
FIG. 15 is a perspective view of the disc buffer and disc transfer system.

FIG. 15 is a perspective view of the downstacker 151 station for delivering packages to the machine and the booklet inserter 29.

Figure 16:
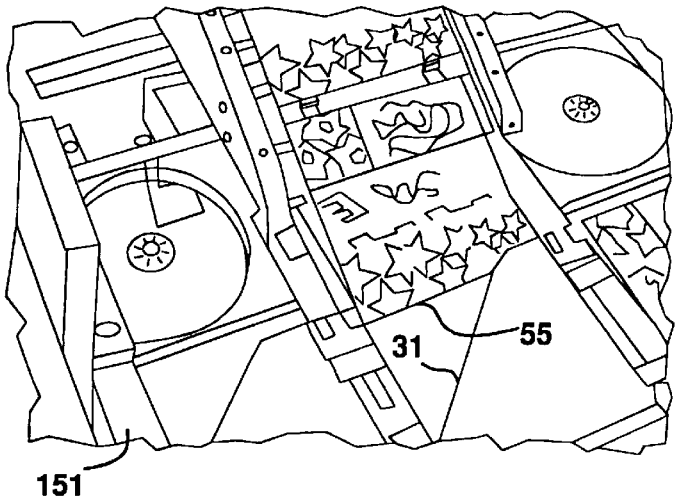
FIG. 16 is a perspective view of the disc placement station.

FIG. 16 is an additional view of the downstacker 151 and the booklet inserter 29 showing an initial insertion of the booklet 55 leading edge into the pocket 31.

Figure 17:
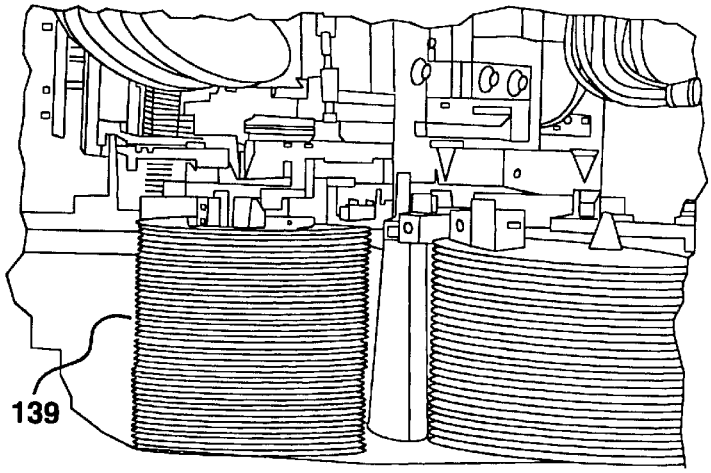
FIG. 17 is a perspective view of a solo driven transfer system.

FIG. 17 is a view of the stacked disc buffer 139 showing also the disc pick end of the disc transfer.

Figure 18:
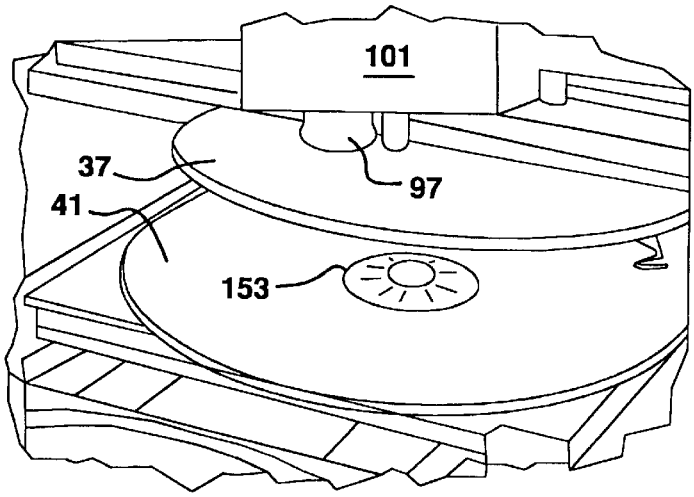
FIG. 18 shows in line two disc and two booklet configurations.

FIG. 18 shows the disc placement station 121 with the vacuum heads 97 ready to engage and strip a disc 37 from the carrying spindle and to place the disc into recess 41 in the package and onto the rosette 153 in the package.

Figure 19:
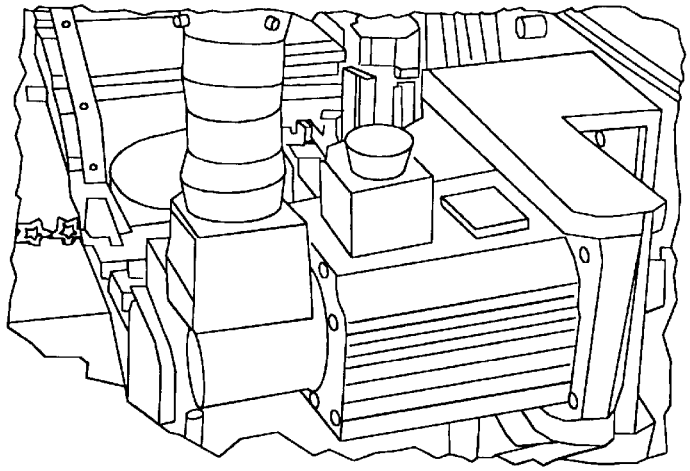
FIG. 19 shows the servo drives for the disc transfer conveyor.

FIG. 19 shows the servo drives 83 for the disc transfer conveyor.

Figure 20:
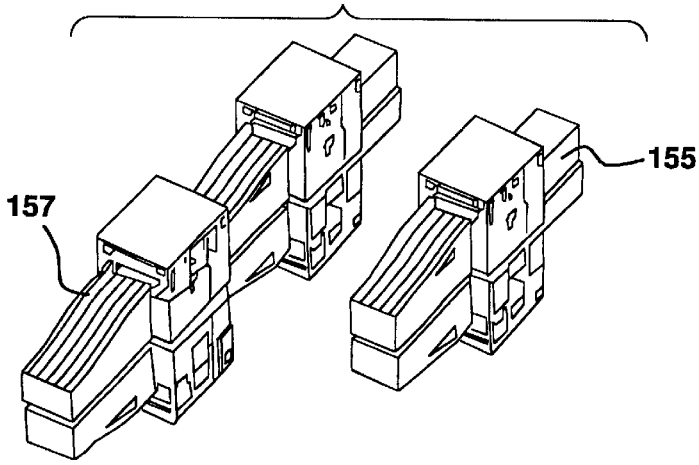
FIG. 20 shows the system for insertion of a disc and a booklet, and an in-line system for a 2-disc, 2-booklet configuration.

FIG. 20 shows the system 155 for insertion of a disc and a booklet, and an in-line system 157 for a 2-disc, 2-booklet configuration.

While the invention has been described with reference to specific embodiments, modifications and variations of the invention may be constructed without departing from the scope of the invention, which is defined in the following claims.

We claim:

1. Insertion automation apparatus for discs and booklets in disc packages, comprising plural parallel belts for transporting containers through successive stations, a first station adjacent the belts for unstacking containers, a second station adjacent the belts for opening the containers, an inspection station adjacent the belts for inspecting the opened containers, a fourth station adjacent the belts for partially inserting booklets in the open containers, the fourth station further comprising a booklet conveyor for unstacking and moving booklets toward the fourth station, and having an insertion conveyor for partially inserting the booklets in booklet pockets of the containers, a fifth station adjacent the belts having a pusher for pushing booklets fully into the pockets, a sixth disc placement station adjacent the belts having a continuous looped disc carrier arranged transversely to the belts, and having plural outwardly spaced disc carrier heads facing outward from the looped disc carrier, suction lifters positioned adjacent one end of the looped disc carrier for engaging and lifting discs from a top of an active stack and pulling the discs onto the carrier heads, and having second placement heads moving vertically with respect to the carrier for engaging the discs on the carrier heads and pushing the discs from the carrier heads to a disc holder in the package on the belts at the sixth station, a disc stack transfer mounted at one side of the belt and extending longitudinally in the direction of the belts for moving emptied stacks from an active position beneath the looped disc carrier to an inactive position, and for moving a loaded stack from an inactive position to the active position under the disc carrier, a seventh position for inspecting the containers with the discs and booklets inserted therein, an eighth station comprising a closer for closing the disc containers, and a ninth station for unloading the closed disc containers.

2. Insertion automation apparatus for discs and booklets in disc packages, comprising plural parallel belts for transporting containers through successive stations, a first station adjacent the belts for unstacking containers, a second station adjacent the belts for opening the containers, an inspection station adjacent the belts for inspecting the opened containers, a fourth station adjacent the belts for partially inserting booklets in the open containers, a fifth station adjacent the belts having a pusher for pushing booklets fully into the pockets, a sixth disc placement station adjacent the belts, a seventh position for inspecting the containers with the discs and booklets inserted therein, an eighth station comprising a closer for closing the disc containers, and a ninth station for unloading the closed disc containers.

3. The apparatus of claim 2, the fourth station further comprising a booklet conveyor for unstacking and moving booklets toward the fourth station, and having an insertion conveyor for partially inserting the booklets in booklet pockets of the containers.

4. The apparatus of claim 2, further comprising a continuous looped disc carrier arranged transversely to the belts, and having plural outwardly spaced disc carrier heads facing outward from the looped disc carrier, suction lifters positioned adjacent one end of the looped disc carrier for engaging and lifting discs from a top of an active stack and pulling the discs onto the carrier heads, and having second placement heads moving vertically with respect to the carrier for engaging the discs on the carrier heads and pushing the discs from the carrier heads to a disc holder in the package on the belts at the sixth station.

5. The apparatus of claim 2, further comprising a disc stack transfer mounted at one side of the belt and extending longitudinally in the direction of the belts for moving emptied stacks from an active position beneath the looped disc carrier to an inactive position, and for moving a loaded stack from an inactive position to the active position under the disc carrier.

6. Insertion automation apparatus for discs and booklets in disc packages, comprising plural parallel belts for transporting containers through successive stations, a first station adjacent the belts for unstacking containers, a second station adjacent the belts for opening the containers, an inspection station adjacent the belts for inspecting the opened containers, a fourth station adjacent the belts for partially inserting booklets in the open containers, a fifth station adjacent the belts having a pusher for pushing booklets fully into the pockets, a sixth disc placement station adjacent the belts, a seventh position for inspecting the containers with the discs and booklets inserted therein, an eighth station comprising a closer for closing the disc containers, and a ninth station for unloading the closed disc containers, wherein the fourth station further comprises a booklet conveyor for unstacking and moving booklets toward the fourth station, and having an insertion conveyor for partially inserting the booklets in booklet pockets of the containers.

7. Insertion automation apparatus for discs and booklets in disc packages, comprising plural parallel belts for transporting containers through successive stations, a first station adjacent the belts for unstacking containers, a second station adjacent the belts for opening the containers, an inspection station adjacent the belts for inspecting the opened containers, a fourth station adjacent the belts for partially inserting booklets in the open containers, a fifth station adjacent the belts having a pusher for pushing booklets fully into the pockets, a sixth disc placement station adjacent the belts, a seventh position for inspecting the containers with the discs and booklets inserted therein, an eighth station comprising a closer for closing the disc containers, and a ninth station for unloading the closed disc containers, having a continuous looped disc carrier arranged transversely to the belts, and having plural outwardly spaced disc carrier heads facing outward from the looped disc carrier, suction lifters positioned adjacent one end of the looped disc carrier for engaging and lifting discs from a top of an active stack and pulling the discs onto the carrier heads, and having second placement heads moving vertically with respect to the carrier for engaging the discs on the carrier heads and pushing the discs from the carrier heads to a disc holder in the package on the belts at the sixth station.

8. Insertion automation apparatus for discs and booklets in disc packages, comprising plural parallel belts for transporting containers through successive stations, a first station adjacent the belts for unstacking containers, a second station adjacent the belts for opening the containers, an inspection station adjacent the belts for inspecting the opened containers, a fourth station adjacent the belts for partially inserting booklets in the open containers, a fifth station adjacent the belts having a pusher for pushing booklets fully into the pockets, a sixth disc placement station adjacent the belts, a seventh position for inspecting the containers with the discs and booklets inserted therein, an eighth station comprising a closer for closing the disc containers, and a ninth station for unloading the closed disc containers, a disc stack transfer mounted at one side of the belt and extending longitudinally in the direction of the belts for moving emptied stacks from an active position beneath the looped disc carrier to an inactive position, and for moving a loaded stack from an inactive position to the active position under the disc carrier.

* * * * *